United States Patent [19]

Akoh et al.

[11] 4,089,255

[45] May 16, 1978

[54] METHOD FOR MAKING A BAG-IN-CARTON

[75] Inventors: Shigeichi Akoh, Yotsukaido; Hiroo Harada, Kyoto; Yutaka Ueda; Masao Kurosawa, both of Tokyo, all of Japan

[73] Assignee: Honshu Seishi Kabushiki Kaisha, Tokyo, Japan

[21] Appl. No.: 714,962

[22] Filed: Aug. 16, 1976

[30] Foreign Application Priority Data

Jul. 16, 1976 Japan ..... 51-84551

[51] Int. Cl.[2] ..... B31B 7/00

[52] U.S. Cl. ..... 93/36.01; 53/175

[58] Field of Search ..... 93/36.01, 33 H, 35 R; 53/175, 385, 384

[56] References Cited

U.S. PATENT DOCUMENTS

| | | | |
|---|---|---|---|
| 1,692,986 | 11/1928 | Hardy et al. | 93/36.01 X |
| 2,369,013 | 2/1945 | Braloff | 93/36.01 X |
| 3,314,210 | 4/1967 | Järund | 53/175 X |
| 3,485,145 | 12/1969 | Jones | 93/20 |
| 3,774,509 | 11/1973 | Heinzer | 53/175 X |
| 3,775,945 | 12/1973 | Kuhnle | 53/385 |

*Primary Examiner*—James F. Coan

*Attorney, Agent, or Firm*—Wenderoth, Lind & Ponack

[57] ABSTRACT

A method is disclosed which makes a bag-in-carton by successively and intermittently advancing cartons, the upper ends of which are opened, and during the advancement successively supplying each of the cartons with a flattened bag, and subsequently blowing up the bag. A bag supplying apparatus and a bag blowing up apparatus used for performing the method are also disclosed. The bag supplying apparatus comprises means for supplying tubular material, roller means for intermittently advancing the material, means for providing the material with side folds while the material is being advanced, means for heat sealing the side folded material thereacross at the places spaced by the distance equal to the desired length of the bag to form bottom seams, and means for cutting the material just below the bottom seams to provide bags. The bag blowing up apparatus comprises vacuum horns for forcibly opening the unsealed end of a bag and lid means for blowing up the bag after it contacts the opened end for air sealing thereof.

3 Claims, 11 Drawing Figures

METHOD FOR MAKING A BAG-IN-CARTON

BACKGROUND OF THE INVENTION

This invention relates to a method and apparatus for automatically making a so-called "bag-in-carton" which is a container having a bag therein.

A bag-in-carton, which is a combination of a paperboard carton and a bag made of plastic, metal foil or the like, has been used as a container for products which need air tight packing or for some kinds of liquid.

A typical method for making such bag-in-carton comprises cutting a tube of bag material to provide a length of the tube, sealing one end of the length of the tube to form a bag, folding a flat carton blank which is punched out from a sheet of paper board so as to enclose the bag therein and forming a rectangular paper tube and adhering the bag to the carton blank. During the above folding step, upper and lower end flaps of the blank are not folded. The obtained rectangular tubes are collapsed and then stored flat. When the flattened carton tubes are used, the tubes are set up into a rectangular form and the bags therein which are bonded to the carton tubes are concomitantly opened. Then, the flaps of the end of each of the carton tubes adjacent the sealed end of the bag therein are folded and bonded to each other to close the end, and then the carton with one end closed is fed to a product loading machine.

According to such a method, the rectangular carton tubes are stored flat for a long time. Thus, if the material of the bags in the carton tubes is apt to cause blocking or sticking, the carton tubes are not easily set up when they are going to be used. Furthermore, at least a portion of the bag is fixed to the carton. Therefore, forces applied from outside of the product loaded carton, for example during transportation thereof, tend to be directly transmitted to the interior of the bag thereby causing a problem of damage to the products in the bag. Furthermore, when the process for combining the carton and the bag is effected automatically, it is necessary to accurately synchronize the feeding of the carton blanks with that of the bags and to make constant the orientations of the cartons and the bags. For so dealing with bags, it is necessary that the bags have certain stiffness.

Another typical method comprises putting a sheet of bag material around a mandrel, heat sealing the side seam and the bottom portion of the bag material to form a bag, and putting a carton blank around the bag and bonding the bag and carton at certain places or throughout. In this method, too, problems arise unless the bag material has certain stiffness; for example, the bag material curls or does not conform to the mandrel. Furthermore, this method is also accompanied with the problem of damage to the packed products during transportation as in the first method, since bonding between the bag and carton is necessary.

Mechanisms and the process used in the abovementioned two methods for bonding bags to cartons are complicated and time consuming. Thus, they significantly increase the cost of completed packages.

Another typical method comprises separately preparing a bag and a carton, putting products in the bag and thereafter inserting the loaded bag in the carton. According to this method, the possibility of damage to the products during transportation decreases since the bag is not fixed to the carton. It has been experimentally proven there is less damage to the products when the bag is not fixed to a carton than when the bag is fixed to the carton. Thus, the bag-in-carton made by the third mentioned method is suitable for containing snacks such as biscuits and potato chips. However, the loaded bag is not evenly shaped. Usually, the lower portion of the loaded bag tends to become larger than the upper portion. Thus, if the loaded bag is to be inserted in a carton having a size closely corresponding to that of the bag, it is necessary to manually reform the loaded bag to an appropriate shape. Or, if the loaded bag is to be inserted automatically in a carton, it is necessary that the carton be much larger than the bag thereby increasing the cost and provoking complaints from consumers.

SUMMARY OF THE INVENTION

One object of this invention is, therefore, to provide a method for automatically making a novel bag-in-carton which can eliminate the aforementioned problems. For eliminating the problems, in this method, cartons are previously prepared separately from bags and the upper end of the carton is left open; then the bags are automatically fed into the cartons; and thereafter bags are automatically opened for readily receiving products to be packed therein.

Another object of the invention is to provide a bag supplying apparatus and a bag blowing up apparatus for enabling achievement of the method of this invention.

Other objects and features of the invention will be understood from the embodiment explained below referring to the accompanying drawings.

DETAILED DESCRIPTION OF THE PREFERRED EMBODIMENT

Figures 1, 2:
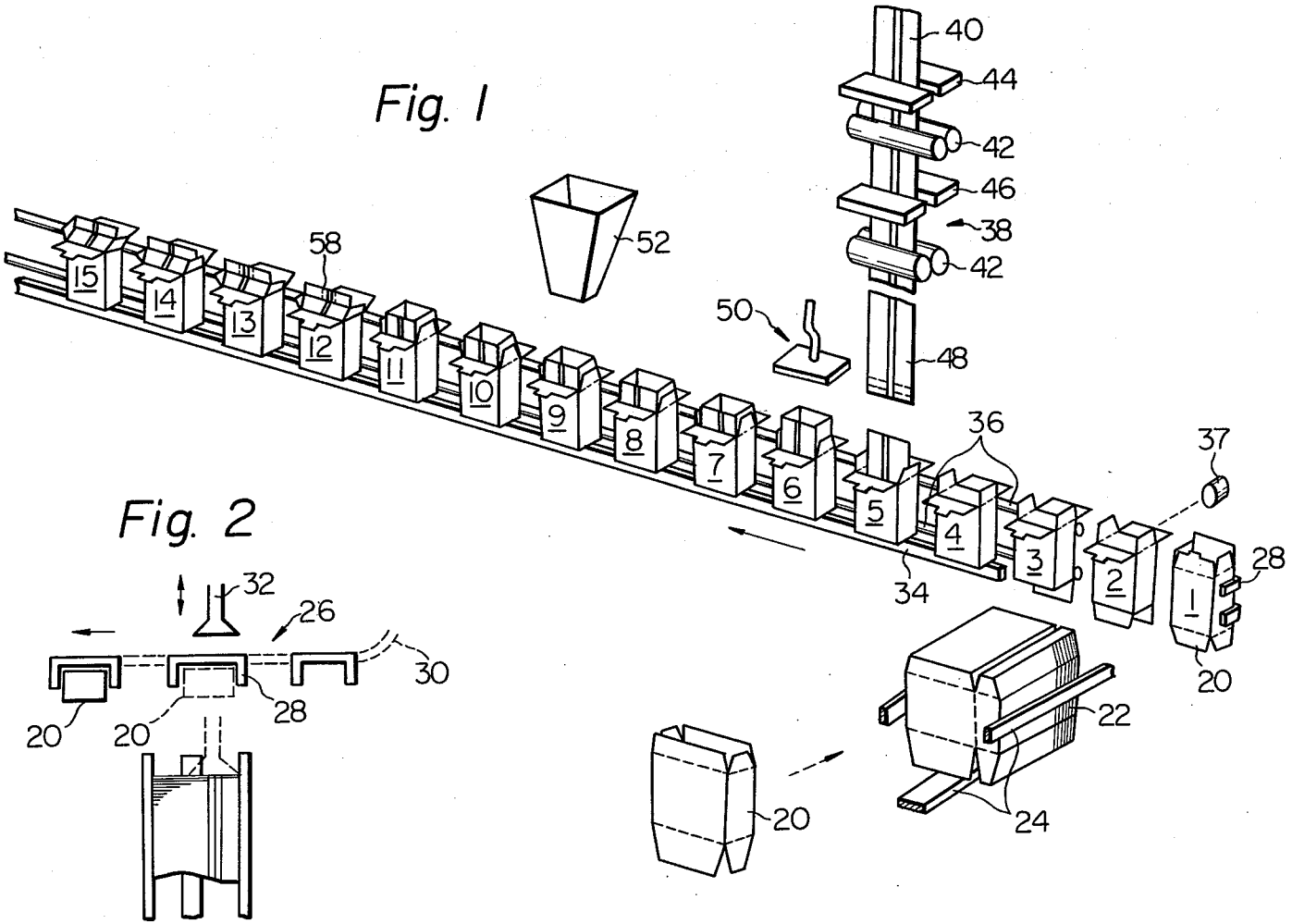
FIG. 1 is a perspective view of general construction of a packing machine used for achieving a method of this invention.
FIG. 2 is a partial illustration of conveyor means of the machine of FIG. 1 and a mechanism for transferring a partially formed carton from a rack therefor to a carton holder of the conveyor means.

FIG. 1 schematically shows an automatic packing system for achieving the method of this invention, in which many structural parts are omitted for convenience of illustration. A bundle 22 of flattened partially formed paper cartons 20, which are previously prepared by folding carton blanks into a rectangular tubular configuration and adhering side flaps, is disposed on a carton rack 24. A carton conveyor 26 (FIG. 2) is disposed perpendicularly to the carton rack 24. The conveyor 26 may be of a well known closed loop type construction comprising carton holders 28 fixed to a chain 30 at appropriate intervals along the chain. The conveyor 26 is intermittently advanced in the direction indicated by the arrow so that respective holders 28 are successively aligned with the carton rack. When a holder 28 stops in alignment with the rack, a vacuum pickup head 32 is pushed toward the bundle of the partially formed cartons to the position indicated by the broken line in FIG. 2 and then, after it picks up one of the partially formed cartons, returns to its original position (indicated by the solid line in FIG. 2). During this movement of the pick up head, one of the partially formed cartons 20 is received in the holder 28, and it is automatically set up by the movement thereof into the holder. Then the next indexing movement of the conveyor is effected. The operations above are repeated so that the partially formed cartons are successively fed along the conveyor 26. For convenience of illustration, only the holder 28 at the position adjacent the rack 24 is shown in FIG. 1. However, it should be understood that each of the respective cartons 20 in FIG. 1 is supported by a holder.

During the movement of each of the cartons 20 from the position 1 to position 4, bottom flaps thereof are folded and bonded. These operations may be made by adhesive supply means and any of suitable folding rails fixed to a frame (both not shown) which are well known to those skilled in this technical field. During this movement of the carton, the forward and backward upper flaps are arrested in opened or horizontal position by similar folding rails (not shown). The partially formed cartons may be supported after an appropriate position by a support rail 34 and guide rails 36 so that the holders 28 only work to shift the cartons. Although in the illustrated embodiment a structure similar to the guide rails 36 is provided before the cartons, it is not shown in the drawing for convenience of illustration. A carton detector 37 may be provided at an appropriate place so as to stop the entire automatic packing system upon detecting absence of a carton. Such detector may be of any well known construction such as one using a photocell.

In the illustrated embodiment, a bag supplying apparatus 38 is associated at position 5 with the conveyor. The apparatus 38, although details of the construction thereof will be explained later, includes nip roller means 42 for intermittently advancing a flattened continuous tube 40 of bag material, heat sealing means 44 and a cutter 46 for severing the tube 40 at a place just below the heat sealed portions to form individual bags 48. The carton 20 supplied with the bag 48 at the position at which the bag supplying means is provided is then transferred to the position 6 where the unsealed end of the bag is first opened and then blown up by a bag blowing up apparatus 50 the details of which will be explained later. The assembly of the bag and the carton in the position 6 is now a bag-in-carton which is ready for receiving products to be packed. The assembly is then supplied with the products by a loading apparatus 52 situated at the loading position 9. The loaded assembly is then further transferred while partial sealing of the upper opening of the bag (at the position of 12), air evacuation from the interior of the bag through a air passage 58 left unsealed during the partial sealing (at 13) and complete sealing (at 14) are affected. Then the upper flaps of the carton are closed to complete the packing process. The mechanisms for partial and complete sealing of the bag and for the air evacuation used for the purpose just above are conventional in the technical field for packing products in bags. So, they are not shown in the drawings.

Figure 3:
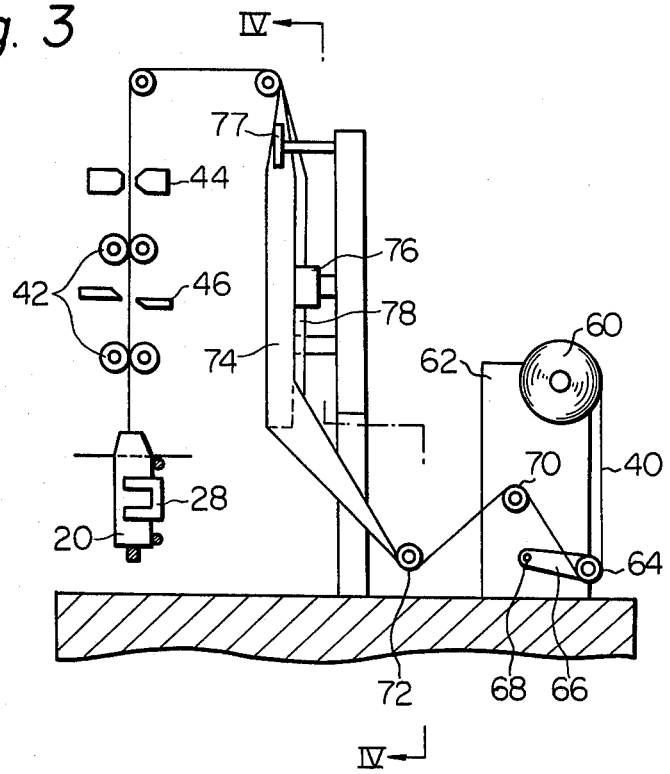
FIG. 3 is a side elevational view of means for supplying bags in the cartons taken along the line of III—III in FIG. 4.
Figure 4:
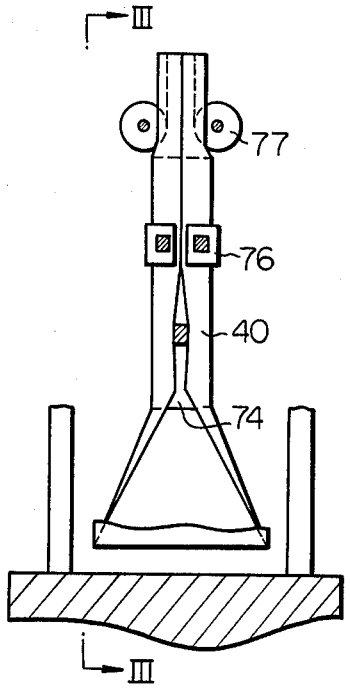
FIG. 4 is a schematic view of means for forming a sheet material into tubular configuration taken along the line of IV—IV in FIG. 3.

Referring to FIG. 3, there is shown the bag supplying apparatus in more detail in which reference 60 designates a supply roll of a sheet 40 of the bag material. Typical materials for the sheet 40 are a multilayer sheet comprising a base sheet of appropriate material such as metal foil and various kinds of plastics chosen according to application and thermoplastic resinous film applied on the base sheet; such thermoplastic film may be of polypropylene, polyethylene, vinyl acetate, vinyl chloride, vinyl acetate co-polymer or the like. However, it should be understood that the sheet 40 is not limited to "multilayer" form and the abovementioned materials; any sheet having heat sealable characteristic can be used. Since the sheet 40 is intermittently advanced by the roller means 42, a dancer roller 64 is provided for damping tension in the sheet. The dancer roller is mounted on an arm 66 which is pivotally connected to a frame 62 at a place designated by 68 and biased clockwise as viewed in the drawing. Thus, as the tension in the sheet increases, the dancer roller goes up to relieve the tension. After passing around guide rollers 70 and 72, the sheet 40 is wound on a forming post 74 and then side flaps or the side marginal portions 78 are heat sealed to each other so as to form a tube by heat sealing means 76. For arresting the sheet while it is wound on the post and making it closely conform to the same, an appropriate guide plate (not shown), for example, one encompassing the post with a clearance corresponding to the thickness of the sheet therebetween, may be employed.

Then, the tubular sheet passes between gusset forming discs 77 to form side gussets which is one form of side folds and is thereafter flattened without dissolving the gussets. At a place upstream of the upper rollers of the feed roller means 42 along the sheet, there is provided bottom heat sealing means 44. The feed roller means intermittently advances the sheet by the distance corresponding to the length of the bag each time and the heat sealing means 44 heat seals across the width of the sheet for forming a bottom seam while the sheet is stopped. While the transverse heat sealing is being effected, the sheet is severed at a place just below the preceding transversely sealed portion by the cutter means 46, and thereupon, the separated sheet portion (now an individual bag) is fed into the carton by the lower rollers of the roller means 42.

Figure 5:
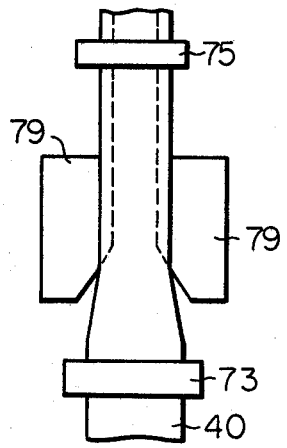
FIG. 5 is a plan view of one example of means for forming side folds in the tubular material to be used.
Figure 6:
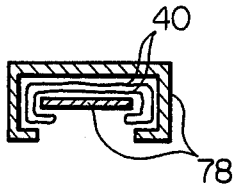
FIG. 6 is a sectional view showing a modification of the form of the side folds.

When marginal originally having a tubular configuration such as an inflated tube is used, the mechanism (74 and 76) for forming the tube can be omitted. Even in that case, however, it is necessary to form side folds since the width of the simply flattened tube is greater than the width of the carton 20. In this connection, it is easy to form the gusset in the structure shown in FIG. 3 since the tube takes an expanded form. However, when the material originally having a tubular form is used, it is convenient, as shown in FIG. 5, to arrest the tube 40 by pinch roller means 73 and another pinch roller means 75 and to provide guide plates 79 between the pinch roller means 73 and 75 so that as the tube passes along the guide plates 79 it is forced to conform to the guide plates. Typical materials of such tube are polyethylene inflation film and co-extruded composite tubular materials made of, for example, polypropylene and polyethylene; nylon and polyethylene; and polyvinylidene chloride and polyethylene. However, this invention is not limited to these materials; any multilayer tube the inner layer of which is heat sealable or any single layer tube having heat sealable characteristic may be used. In either case, whether a tube made out of a sheet or material originally having a tubular form is used, the sides of the tube may be turned as shown in FIG. 6 as another form of the side folds by appropriate guide means (guide plates 78 in the illustrated example). In FIG. 6, opposite walls of the tube 40 are exaggeratedly spaced for convenience of illustration.

The bag blowing up apparatus 50 will be explained below in more detail.

Figure 7A:
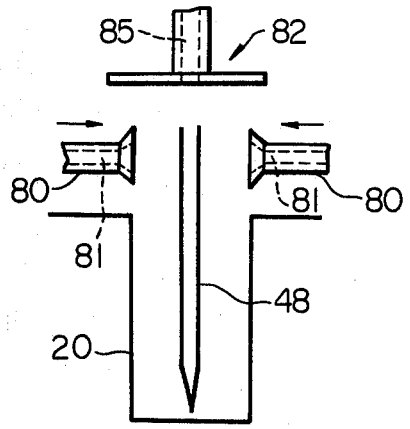
FIGS. 7A through 7D are schematic illustrations showing successive steps for blowing up a bag.
Figure 7B:
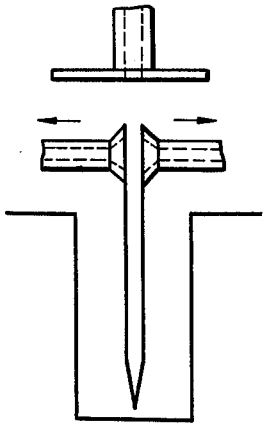
Figure 7C:
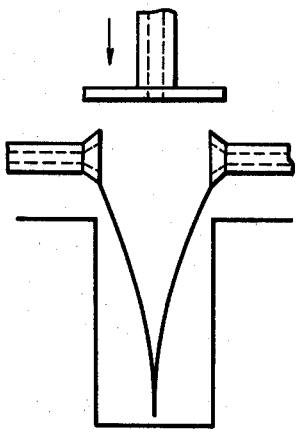
Figure 7D:
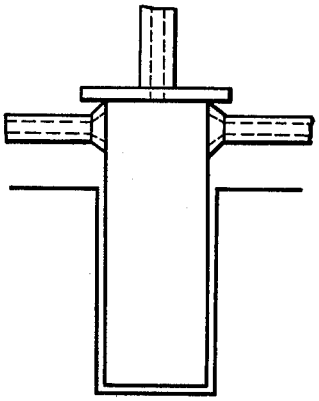
Figure 8:
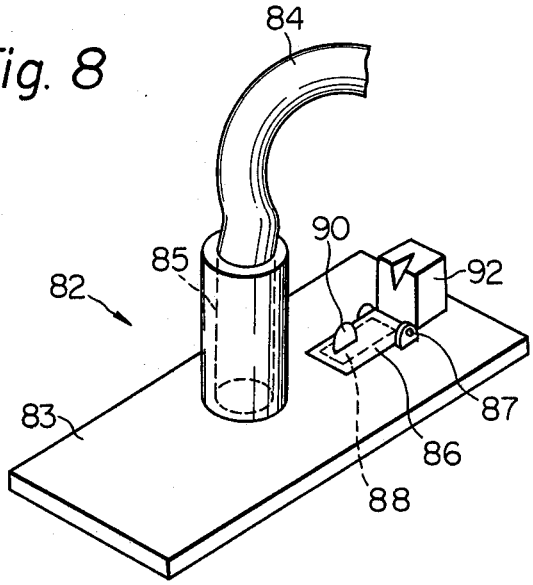
FIG. 8 is a perspective view of lid means of a blowing up apparatus.

As is shown in FIG. 7A, the bag blowing up apparatus comprises vacuum horns 80 and lid means 82 having air supplying means. The vacuum horns have vacuum ducts 81 connected to a vacuum source (not shown) and the lid means has an air duct 85 connected to a pressurized air source (not shown). When a carton 20 having a flat bag 48 therein reaches the position 6, the vacuum horns 80 are actuated so as to contact the bag (FIG. 7B). Then, the vacuum is applied through the ducts in the vacuum horns so that the horns suck the bag. Then, the upper end of the bag is opened by the movement of the vacuum horns to the original position (FIG. 7C). At the same time, the lid means 82 is lowered to the position for covering the opened end of the bag. Then, air is supplied to the bag 48 through a flexible pipe 84 (FIG. 8) connected to the duct 85 of the lid means 82 to blow up the bag to the extent that the bag generally conforms to the inner walls of the carton 20. Mechanisms for moving the vacuum horns laterally and the lid means vertically while maintaining the communication with the vacuum source and the pressurized air source, respectively, are well known to those skilled in the art. Thu, they are not shown in the drawings.

If a carton 50 having therein a bag 48 which is not fully blown up is moved to the position 9 and the products are charged into the bag, the expensive products are wasted. In this invention, to prevent this problem, means for detecting whether the bag is fully blown up or not is provided. Such detecting means may comprise a flapper 86 which is biased by a spring (not shown) toward the position covering a vent opening 88 in a baffle plate 83 of the lid means. The strength of the spring is so selected that the flapper swings about the pivoting point 87 against the biasing effect when the pressure in the bag reaches a predetermined value after the bag is blown up and is further supplied with air through the flexible pipe 84 communicated with the pressurized air source. A switch 92 is also mounted on the baffle plate 83 and is adapted to be actuated by the swing of the flapper 86. Such actuation of the switch may be performed by a blade 90 fixed to the flapper. The switch may be associated with a control circuit which stops supplying the product to the corresponding bag when the switch is not actuated at the time when it should be actuated unless there is any trouble. Alternatively, the switch may be so arranged that it stops the operation of the whole packing system. The detecting means also can inform of the presence of trouble when there is no bag in the sensed carton, since the flapper 86 does not swing up also in that case. Therefore, a separate detector for sensing the presence of the bag in the carton does not need to be provided. After completion of the bag blowing up operation, the vacuum horns 80 and the lid means 82 return to their respective original positions (FIG. 7A).

The abovementioned movement of the pick up head 32 and the operations of the movable elements of the bag supplying apparatus 38, the bag blowing up apparatus 50, the loading apparatus 52 and other mechanisms can be obtained from a power source of the conveyor 26 through cams, links, chains or the like while maintaining an appropriate timing relative to the operation of the conveyor 26. Some solenoids may be employed, if necessary, and the actuation thereof may be controlled in an appropriate timing relative to the operation of the conveyor. Such means for transmitting force and for controlling the operations are conventional in this technical field.

As is explained above, in this invention the bags are made out of a continuous sheet or tube separately from the cartons and are inserted in the cartons just before the loading of the products. Therefore, the material of the bags does not need to have certain stiffness to be handled. Furthermore, since the bags are forcibly opened by the vacuum horns and the lid means, the tendency of the material of the bags for blocking or sticking does not cause substantial troubles. Therefore any kind of material may be used for the sheet from which the bags are made. Furthermore, in this invention, a process for bonding the bags to the cartons, which needs a complicated mechanism, is unnecessary. Moreover, the carton used for a bag of a given size can be made smaller than that of a carton used in the conventional method for automatically assembling separately prepared carton and bag, thereby enabling reduction of cost.

What is claimed is:

1. A method for making a bag-in-carton comprising the steps of:

successively and intermittently advancing cartons, the upper flaps of which are opened, along a given path;

successively supplying flattened bags into said respectively opened cartons at a bag supplying position along said path; and blowing up the bags in said cartons at a bag blowing position downstream from said bag supplying position along said path, said blowing up procedure including:

opening the unsealed end of said bag by vacuum horns;

covering said opened end with a baffle plate; and supplying air to said bag through a duct extending through said baffle plate.

2. A method according to claim 1, wherein said step of supplying the flattened bags in the respective cartons includes:

intermittently feeding continuous tubular material;

during this feeding, forming side folds in the tubular material;

transversely heat sealing the tubular material having side folds at points corresponding to the length of the bag; and successively severing the tubular material at places just below the heat sealed portions to make individual bags.

3. A method according to claim 1, wherein the step of supplying the flattened bags in the respective cartons includes:

forming a flat sheet into a tubular configuration;

heat sealing the side seam formed as a result of said forming of the sheet into a tubular configuration;

intermittently feeding the thus obtained tube;

during this feeding, forming side folds in the tube;

transversely heat sealing the tube having side folds at points corresponding to the length of the bag; and successively severing the tube at places just below the transversely heat sealed portions to make individual bags.

* * * * *